United States Patent [19]

Bascou

[11] 4,435,007

[45] Mar. 6, 1984

[54] LOCKING DEVICE FOR PIVOTING WINDOW

[75] Inventor: Jacques Bascou, Boulogne-Billancourt, France

[73] Assignee: Regie Nationale des Usines Renault, Boulogne-Billancourt, France

[21] Appl. No.: 254,735

[22] Filed: Apr. 16, 1981

[30] Foreign Application Priority Data

May 8, 1980 [FR] France ..... 80 10260

[51] Int. Cl.[3] ..... E05C 17/12

[52] U.S. Cl. ..... 292/268; 292/272; 292/277

[58] Field of Search ..... 292/DIG. 6, 113, 268, 292/271, 272, 263, 273, 274, 275

[56] References Cited

U.S. PATENT DOCUMENTS

| | | | |
|---|---|---|---|
| 976,472 | 11/1910 | Lederer | 292/113 X |
| 3,844,591 | 10/1974 | Velcover | 292/113 X |
| 3,974,753 | 8/1976 | Blomgren et al. | 292/263 X |
| 3,986,742 | 10/1976 | Heaney | 292/268 |
| 4,206,939 | 6/1980 | Rowley | 292/263 |
| 4,257,632 | 3/1981 | DeStepheno | 292/263 |

FOREIGN PATENT DOCUMENTS

| | | | |
|---|---|---|---|
| 134327 | 8/1946 | Australia | 292/268 |
| 5966 | 5/1956 | Fed. Rep. of Germany | 292/272 |
| 950352 | 9/1956 | Fed. Rep. of Germany | 292/271 |
| 2220658 | 10/1974 | France | 292/268 |
| 1015997 | 1/1966 | United Kingdom | 292/DIG. 6 |
| 2068451 | 8/1981 | United Kingdom | 292/268 |

*Primary Examiner*—Gary L. Smith
*Assistant Examiner*—R. Illich
*Attorney, Agent, or Firm*—Oblon, Fisher, Spivak, McClelland & Maier

[57] ABSTRACT

A locking device for a pivoting window includes a link which is completely embeddable inside the body of the lock mounted on a frame and a strap affixed to the window, the link being set in motion by a combination of sliding and pivoting movements transmitted from the translation motion of an operating knob, parallel to the body of the lock and obtained with pawns attached to the link evolving inside knob-holes of the strap and the body of the lock. This low-crowding device enables locking of the window with constant compression of the watertightness joint of the window.

8 Claims, 6 Drawing Figures

LOCKING DEVICE FOR PIVOTING WINDOW

BACKGROUND OF THE INVENTION

1. Field of the Invention

This invention concerns a device enabling the locking of a pivoting window in closed or half-open positions, especially a pivoting side window of a motor vehicle.

2. Description of the Prior Art

In the prior art, locking devices for pivoting windows are known which usually include two articulated links, arranged facing the pivoting axis of the window. Among the disadvantages displayed by such devices, one can note the lack of watertightness which they offer the window as a result of a loss of pressure of the watertightness joint following misalignment of the articulating points of the link needed to lock the window. Also, the path of the control link during its operation protrudes inside the vehicle, triggering changes of resistance to movement in the event that the half-opened window becomes such only half way into its movement.

A remedy to the previous technical problems was already described in the French Patent Application No. 78.31.210, filed by this applicant. This device includes an articulated link, on the one hand, with sliding motion inside a lever mounted for pivoting onto a stand, and on the other hand, to a strap mounted with a certain degree of rotation on a seating at the window and a set of cams in contact for locking (unlocking of the lever in a closed or half-opened position of the window).

SUMMARY OF THE INVENTION

An object of the present invention is designed to offer a new remedy, which is simpler and more economical, to the previous questions of watertightness and cumbersomeness by which the watertightness joint of the window remains at a compression level that is constant throughout the locking/unlocking maneuver.

According to the invention, the structure of the lock allows for a minimum of mobile items which can be embedded into one another in order to reduce crowding of the totality while their movement developed during the half-open maneuver of the window create no additional protrusions inside the vehicle.

The device is characterized mainly in that it includes a link completely embeddable inside the body of the lock mounted onto the frame and of the strap affixed to the window, the link being set in motion by a combination of sliding and pivoting movements transmitted from the translation of an operating knob parallel to the body of the lock.

Maneuvering of the knob first triggers the translation of the link on two extreme pawns sliding inside guidance knob-holes formed in the body and in the strap to unlock the link. The continuation of the operation of the knob then triggers the half-opening of the window because the pawns also serve as pivots for articulating the link, especially, when they are thrust into their respective knob-holes. The link therefore constitutes the single mobile piece of the mechanism.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
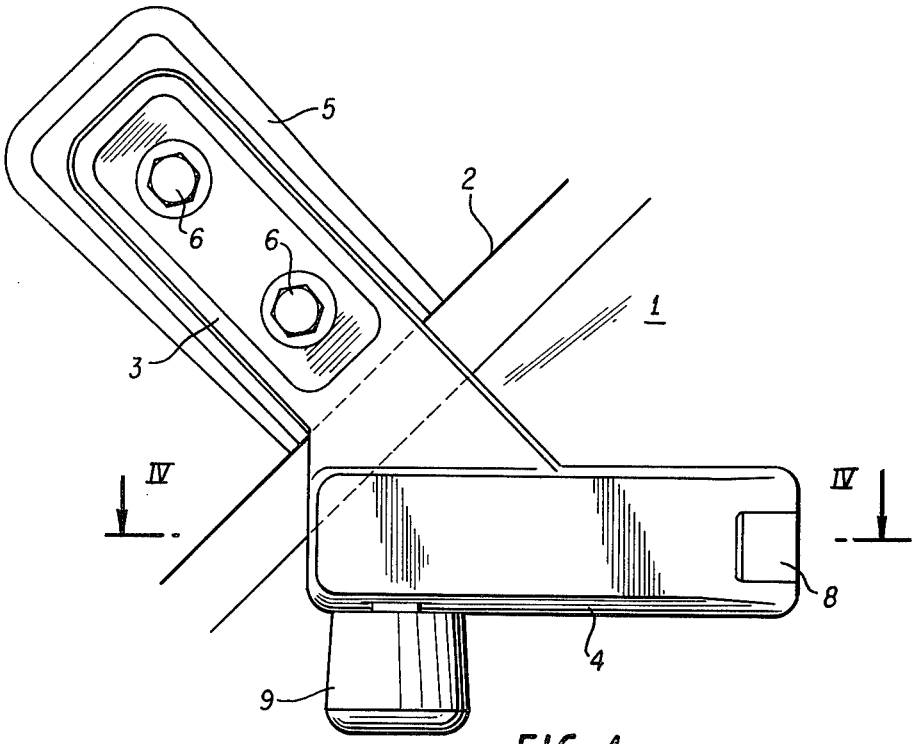
FIG. 1 is an elevated view of the mounted device of the present invention, as viewed from inside a vehicle.

FIG. 1 represents the locking and half-open device of a pivoting side window 1, mounted on the contiguous body 2 which determines the framing of the window with a fixing clip 3, extending the body 4 of the lock, set up and sustained in a pressing 5 of the frame with two screws 6.

The lock mainly includes a hollow body 4 of a strap 7 affixed to the window 1 and a mobile link 8 which is prone to be embedded completely inside the lodging formed by the body 4 and the strap 7 and activated by an operating knob 9. Each of these items are preferably synthetically manufactured.

Strap 7 is affixed to the inside face of the window 1 and is sustained against it with a screw 10 that crosses the window and fits into an unremovable outer bolt 11, with a round head, with interposition on the outer side of the window of a badge 12 to form a watertight joint.

Figure 4:
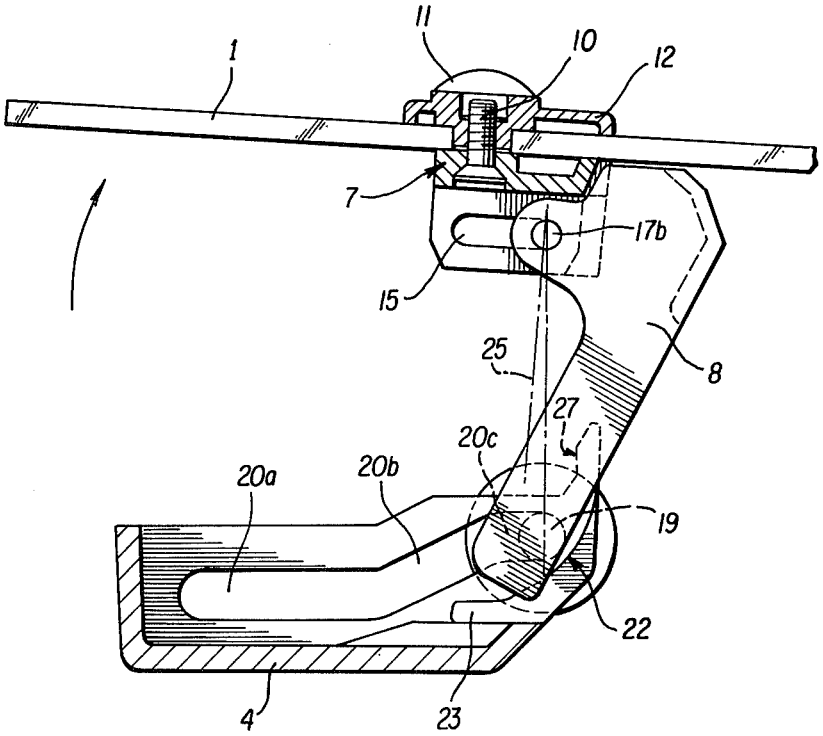
FIG. 4 is a sectional view along line IV—IV of FIG. 1 which shows the window in a half-opened position.
Figure 5:
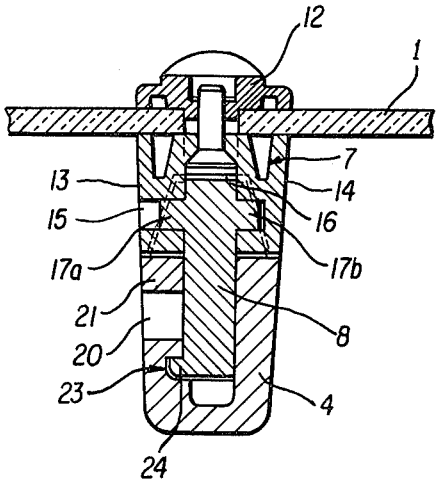
FIG. 5 is a cross sectional view along line V—V of FIG. 2.
Figure 6:
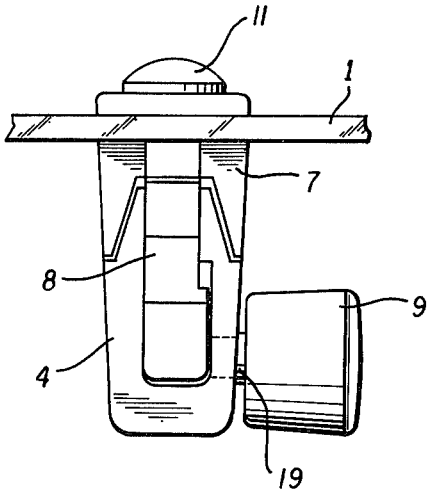
FIG. 6 is a side view along line VI—VI of FIG. 3.

As shown in FIGS. 4 and 5, wings 13, 14 of strap 7 are crossed by an oblong knob-hole 15, parallel to the plane of the window and form a cross-shaped section with the central lodging 16 of the strap 7 in order to accommodate and guide two opposed pawns 17*a*, 17*b*, borne by the opposite sides of a tip portion of the link 8 which can thus slide inside the knob-hole 15 of the strap and pivot around pawns 17*a*, 17*b*. At its other tip portion, the link is also connected in a mobile manner to the body 4 of the lock with another pawn 19 sliding inside an oblong knob-hole 20 of the body and attached to the operating knob 9 outside the body. Hollow body 4 includes a U-shaped section, a wing 21 of which has a knob-hole 20 formed therein and is crossed by pawn 19 connected to the knob.

The knob of the body includes an oblique portion 20*b* guided to the strap, interspersed between two extreme portions 20*a*, 20*c*, parallel to one another and parallel to the rectilinear knob-hole 15 of the strap when the window is closed.

Furthermore, the inner panel of the wing 21 of the body including the knob-hole forms a curvilinear ramp 22 which extends to the interior of the body 4 by a groove 23 referred to as a locking groove, for accommodating the corresponding side rib 24, formed on the heel of the link 8, which is more clearly visible in FIG. 5. Hence, as shown in FIG. 2, the link 8 can embed itself completely inside the body 4, the heel of the link espousing the outer shape 25 of the lock, on the entry side.

The body 4 of the lock also includes two shoulders 26, 27 to partially encase the strap 7 during closure of the window, which advantageously allows for rigidness and minimal crowding in relation to the plane of the window, towards the interior of the vehicle, thus limiting the changes of too great a protrusion. This result can also be expressed in that, in spite of the length of the link 8 which is needed for sufficient half-opening of the window, the distance between the pawns 17, 19 and the window is limited to a minimal amount.

Figure 2:
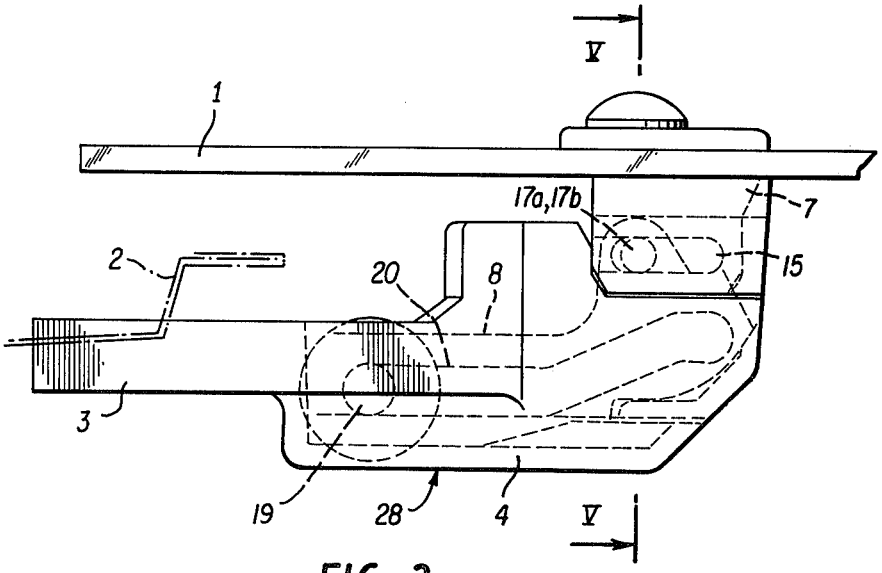
FIG. 2 is a top view of the device in the closed and locked position of the window.

Since FIG. 1 is taken from inside the vehicle, it is noted that the operating knob 9 moves in translation motion under the body 4 of the lock, hence without displaying any additional protrusion towards the interior of the vehicle in relation to the sidewall 28 of the body, furthest away from the window (FIG. 2). On the contrary, the oblique section 20*b* of the knob-hole would tend to be shifted towards the outside. Furthermore, as in the position of use the knob-hole 20 is located under the body and the mechanism is protected against probable intrusion of dust through the knob-hole.

Figure 3:
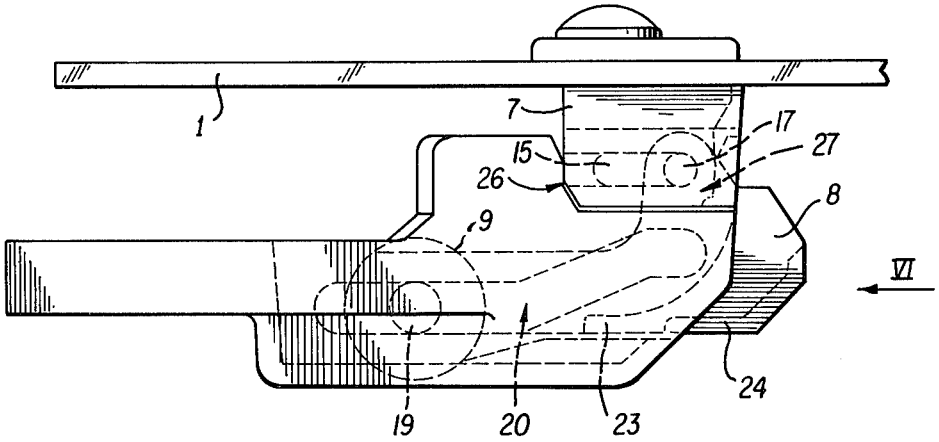
FIG. 3 is a view identical to FIG. 2 but in the unlocked position.

Operation of the device is as follows. Starting from FIG. 2 which represents the window 1 in a closed and locked position, the user moves the operating knob 9 to the right (FIG. 3), guided by the knob-hole 20 of the lock body 4, which frees the locking rib 24 of the link 8 from the corresponding groove 23 of the body. This translation movement of the link 8 is limited by the pawn 17 which comes thrust-wise to a position inside the knob-hole 15 of the strap. From the unlocked position in FIG. 3, following the operating knob 9, pawns 17*a* and 17*b* of the link swivel inside the strap and become pivots for articulating the link. In a circular motion, the link 8 moves away from the strap 7 of the lock body 4 by triggering movement of the window 1 as shown in FIG. 4.

Optimal movement is attained when the pawn 19 attached to the knob 9 reaches the bottom of the knob-hole of the body up to the bearing 20*c* allowing for maintenance of the link in that stable position. Indeed, at the end of the movement, the pawn axis 19 goes beyond the outer shape 25 to the window crossing the axis of the pawns 17 which pivot inside the strap.

Reclosing and locking the window stem from reverse operation of the previous steps. Compression of the water-tightness joint (not represented) of the window in the frame of the window takes place during proper closure, or during the transition from the position shown in FIG. 4 to that of FIG. 3. The locking mechanism, or the transition to FIG. 2 therefore takes place under optimal and continuing compression since the positions of the body 4 and the strap 7 remain affixed, since the link 8 only moves parallel to the plane of the window 1.

During closing, the rib 24 of the link 8 comes into contact with the ramp 22 of the body 4 while the strap becomes encased between the previously mentioned shoulders 26, 27 of the body 4. The translation motion of the pawns 17, 19 inside their respective knob-holes then triggers positive locking with the side rib 24 of the link fitting inside the groove 23 of the body.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A device for locking a pivoting window of a motor vehicle in closed or ajar positions, comprising:

a strap fixed to said window; P1 a static body connected to said motor vehicle;

an embeddable link; and means for slidably and pivotably interconnecting said link to said strap and said static body, wherein the static body includes a curvilinear ramp portion and a locking groove portion formed therein and wherein the link further comprises a cross rib engageable with said curvilinear ramp and said locking groove.

2. A device according to claim 1, wherein said strap and said static body have holes formed therein and said means for slidably and pivotably interconnecting said link comprises a first and second pawn slidably mounted in said holes formed in said strap and said static body which are substantially parallel and parallel to the plane of said window.

3. A device according to claim 2, further comprising a knob connected directly to the pawn slidingly mounted in said hole formed in said static body for operating with a translation motion under the static body.

4. A device according to claims 2 or 3, the hole of the static body forming an intermediate oblique portion directed to the strap and extreme parallel portions at opposite end portions of said intermediate oblique portion serving to lock the window in the closed and ajar positions.

5. A device according to claim 1, wherein during locking operation, the link is completely embedded inside the static body and the strap partly encases the static body.

6. A device according to claim 1 wherein said cross rib is located on a heel portion of said link.

7. A device according to claim 5, wherein said cross rib is located on a heel portion of said link.

8. A device for locking a pivoting window of a motor vehicle enclosed or ajar positions, comprising:

a strap fixed to said window;

a static body connected to said motor vehicle;

an embeddable link; and means for slidably and pivotably interconnecting said link to said strap and said static body wherein during locking operation, the link is completely embedded inside the static body and the strap partially encases the static body, the static body includes a curvilinear ramp portion and a locking groove portion formed therein and wherein the link further comprises a cross rib engageable with said curvilinear ramp and said locking groove.

* * * * *